US005137168A

United States Patent [19]

Möthrath et al.

[11] Patent Number: 5,137,168

[45] Date of Patent: Aug. 11, 1992

[54] JUG FOR STORING HOT BEVERAGES, IN PARTICULAR COFFEE OR TEA

[75] Inventors: Georg Möthrath, Gelnhausen; Thomas Schamberg, Dortmund, both of Fed. Rep. of Germany

[73] Assignee: Braun Aktiengesellschaft, Frankfurt, Fed. Rep. of Germany

[21] Appl. No.: 648,022

[22] Filed: Jan. 30, 1991

[30] Foreign Application Priority Data

Feb. 13, 1990 [DE] Fed. Rep. of Germany ..... 4004298

[51] Int. Cl.[5] ..... A47G 19/00

[52] U.S. Cl. ..... 220/334; 222/500

[58] Field of Search ..... 220/334, 855 P, 912; 222/500, 501, 566, 491

[56] References Cited

U.S. PATENT DOCUMENTS

| | | | |
|---|---|---|---|
| 424,034 | 3/1890 | Sutton | 222/500 |
| 510,354 | 12/1893 | Malke | 222/500 |
| 1,143,656 | 6/1915 | Spahr | 222/500 |
| 1,149,445 | 8/1915 | Holmes | 222/131 |
| 1,273,594 | 7/1918 | Feltner | 222/500 |
| 2,478,352 | 8/1949 | Young | 222/500 X |
| 3,018,025 | 1/1962 | Wynn | 222/500 |
| 3,871,555 | 3/1975 | Collins | 222/131 |

FOREIGN PATENT DOCUMENTS

| | | |
|---|---|---|
| 209042 | 7/1986 | European Pat. Off. . |
| 6607709 | 4/1971 | Fed. Rep. of Germany . |
| 2145362 | 3/1973 | Fed. Rep. of Germany . |
| 790251 | 11/1935 | France . |
| 321076 | 10/1929 | United Kingdom . |

*Primary Examiner*—Steven M. Pollard
*Attorney, Agent, or Firm*—Fish & Richardson

[57] ABSTRACT

The jug (1) serving to store hot beverages, in particular coffee or tea, is furnished on the brim (4) on its top side (3) with a spout (8) which, together with the top side (3) of the jug (1), can be covered by a lid (9). In the horizontal position of the jug (1), the top side (3) is covered in the area of the spout (8) by a flap (15) movable around an axis of rotation (27). When the jug (1) is tilted out of its horizontal position to assume its pouring position, said flap (15) is lifted from the spout (8) in consequence of the force of gravity and/or by forces exerted by the beverage itself.

18 Claims, 2 Drawing Sheets

JUG FOR STORING HOT BEVERAGES, IN PARTICULAR COFFEE OR TEA

Figure 1:
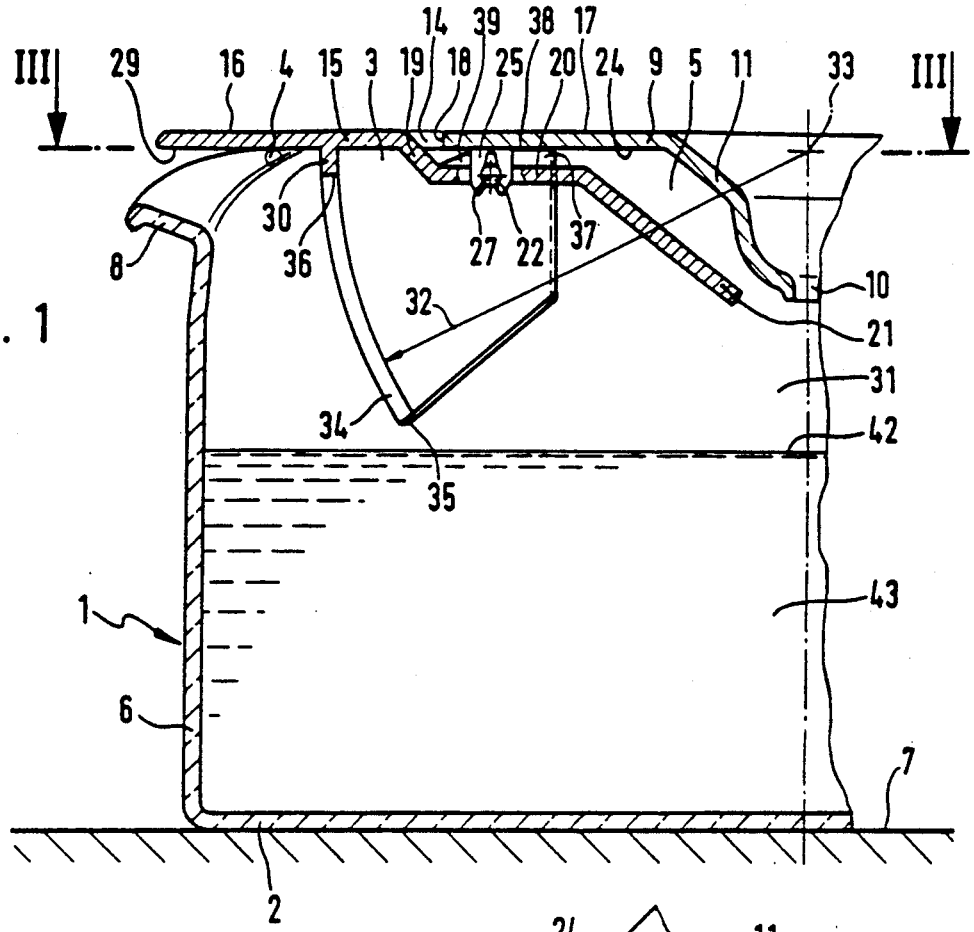

The present invention relates to a jug for storing hot beverages, in particular coffee or tea, the brim of whose top side is provided with a spout which, together with the top side of the jug, can be covered by a lid.

A like jug is already known from German utility model 66 07 709. The lid of the said jug closing the top side of the jug comprises a projection which extends to conform to the opening of the spout and which closes the opening of the spout upwardly when the jug is closed. In order to be able to pour a beverage out of the jug, the lid and its projection either must be removed entirely from the jug, or it has to be turned by 180° in order that the projection releases the spout, if it is desired to prevent the aroma from escaping and to minimize temperature losses. Herein the projection engages a recess which, for receiving it, is conformed to the projection's contour. The spout is open upwards in this position, and although the top side of the jug is closed by the lid the brewed beverage can be poured out of the jug. This arrangement bears the shortcoming that if it is desired to achieve little loss in temperature and aroma in the brewed beverage it is needed each time before and after a pouring action to lift the lid with the projection from the jug, to then twist it by 180° and place it on the jug again. This effort is required because the lid engages into the recess of the projection.

Further, a jug for storing hot beverages is known from EP-0 209 042 A2, wherein the lid closing the top side is pivotally mounted on the jug's grip. In this jug, too, is has to be regarded as less favourable that the lid must be tilted upwards by hand on each pouring action. If this is not done, the brewed beverage will flood out of the top side of the jug in an uncontrolled manner which can undesirably result in contamination of the resting surface, the table cloth etc.

Hence the present invention has for its object to devise a jug for storing hot beverages, in particular tea or coffee, which precludes any loss in temperature and aroma through the spout and which, nevertheless, permits to pour out a brewed beverage through the spout without further manipulation.

This object is achieved according to the present invention in that, in the jug's horizontal position, the top side in the area of the spout is covered by a flap movable about an axis of rotation, which flap is lifted from the spout on tilting of the jug from its horizontal position into its pouring position in consequence of the force of gravity and/or forces exerted by the beverage itself. For the first time ever, this inventive flap prevents the loss in aroma and temperature of the brewed beverage disposed in the jug through the spout. The handling of a jug is not impaired by the flap opening automatically on pouring out of the brewed beverage. The person handling it needs not bother about whether or not the flap has lifted from the top side of the jug during the pouring operation but is allowed to concentrate solely on the alignment of the spout vis-àvis a liquid container, e.g. a cup, to ensure that the brewed beverage reaches its target in the cup without part of it being spilled. The flap according to the invention is lifted from the spout either by the force of gravity or by the flow forces exerted by the brewed beverage itself, or by a combination of both influences in order to constantly keep the spout open for delivery. A like flap with lid is particularly suitable for use on glass jugs for coffee or tea makers.

To cause the flap to lift from the spout due to the flow forces exerted by the beverage itself upon pouring, it is provided in a further embodiment of this invention that a plate extending into the jug's interior is designed on the flap, which latter extends substantially transversely relative to the direction of flow of the beverage flowing out of the jug. When the brewed beverage is poured out, that is when the jug assumes a tilted position, the plate immerses into the brewed beverage, and a dynamic pressure forms due to the outflowing liquid on the wall area of the plate directed to the jug's interior, which pressure causes the flap to swivel upwards away from the spout. Now the liquid may flow unhinderedly through the spout out of the jug into a liquid container placed beneath the spout.

To have a sufficiently high flow pressure act on the plate during the pouring action, it is favourable that the plate extends at a small distance in front of the spout. However, the minimum distance of the plate from the spout must still be at least sized such that a sufficient amount of liquid reaches the spout.

In the event that the plate according to an improvement of this invention comprises a passage which, viewed in the direction of flow of the beverage flowing out through the spout, is placed in front of the spout, the liquid pressure at the plate and the discharge speed at the passage can be determined exactly by varying the passage cross-section. With the passage cross-sections being sized correspondingly, a liquid flow having a higher flow velocity than in conventional jugs can be obtained at the spout so that spilling of the brewed beverage is avoided to the maximum possible extent compared to conventional jugs. The pouring behaviour at the spout is hence improved considerably owing to the passage both on slow and on quick pouring actions, since a higher discharge velocity of the beverage can be reached. This is still favoured in particular in that the passage is formed by a symmetrically extending notch, the plane of symmetry of which extends vertically to the base of the jug. If, in addition, the passage tapers in the direction of the flap, a particularly homogeneous pouring jet which is enclosed in itself will be obtained.

It is proposed in another improvement of this invention that the passage includes an edge of turbulence which projects into the outflowing beverage in the pouring position of the jug. Turbulences are accomplished by the edge of turbulence directly behind the passage to the spout on the upper side of the pouring jet, in consequence whereof condensate drips are washed away which possibly accumulate at the flap. Dripping of the jug is avoided hereby. If, on top of that, the flap is made of transparent material, the course of the liquid can be observed from the top without any condensate drips obstructing the sight. This enhances the pouring accuracy of a jug even more.

It is an advantage that the jug has a curved peripheral surface in the area of the spout, to the shape of which also the contour of the plate lying in this area is conformed. On the one hand, this allows to quickly and simply put the lid on the jug without the person handling it having to pay special attention, while, on the other hand, the brewed beverage flows through the passage to the spout.

The lid can be put on a jug expecially easily when it is pivotally mounted on a bearing point opposite to the spout. The lid is first of all hung into the bearing point and is then loosely inserted onto the brim of the jug by swivelling around the bearing point. To prevent the plate from abutting on the brim of the jug during this closing operation, it is arranged for in an improvement of this invention that the tilting angle of the flap and the spatial expansion of the plate are limited. It is achieved hereby that the plate will not abut on the jug when the lid is tilted about its point of bearing so that the lid falls on the brim of the jug unhinderedly. This measure prevents troublesome handling of the jug.

To ensure that the flap is always safely closing the spout when the jug assumes the horizontal position, it is pivotally mounted on the lig and is furnished with a counterweight. If the axis of rotation of the flap extends substantially vertically in relation to the axis of symmetry of the spout, the flap will open particularly easily when beverages are poured out. In case the opening of the flap is to be effected also by the force exerted by the beverage's flow to the plate, it is favourable that the plate is integral with the flap and extends on both sides beyond the flap underneath the lid. This is because the larger the surface of the plate is, the more increases the amount of force exerted by the flow to the flap and the more rises the torque required to open the flap. That is to say, the larger the surface of the plate is, the smaller the counterweight may be.

It has shown in practice with conventional jugs that when beverages are poured out quickly, the liquid will not only flow through the spout but also sideways over the brim of the jug. Undesirable stains on a table or a tablecloth ensure therefrom in most cases. To preclude this to a largest possible degree, it is proposed in a further improvement of this invention that the first section of the plate extending in front of the axis of rotation up to where the flap commences is provided with a notch which is open towards the lid, which is confined by an upper edge moving in a straight line away from the lower edge of the lid up to the beginning of the flap, the said upper edge starting at the level of the asix of rotation. Hence the notch of the first section, on the one hand, serves as a stop for the flap to prevent it from swinging out beyond a predefined angle, while, on the other hand, it is said first section which permits the movability of the flap at all. Although the notch forms a passage from the jug's interior to the jug's brim in the horizontal position of the lid, it is decreasing more and more in response to the inclined position of the jug until finally it abuts with its uper edge to be flush with the lower edge of the lid. No more liquid is allowed to flow through the notch of the plate outwardly beyond the jug's brim in this position.

In order that the flap has a stop also in relation to the jug when the lid has been taken off, the extension of the plate reaches beyond the axis of rotation of the flap, and in the closed position of the flap the second section of the plate disposed behind the axis of rotation of the flap is flush with the bottom side of the lid. This stop is particularly important when the lid together with the flap is removed from the jug because in this event the flap must not swing downwardly.

Figure 2:
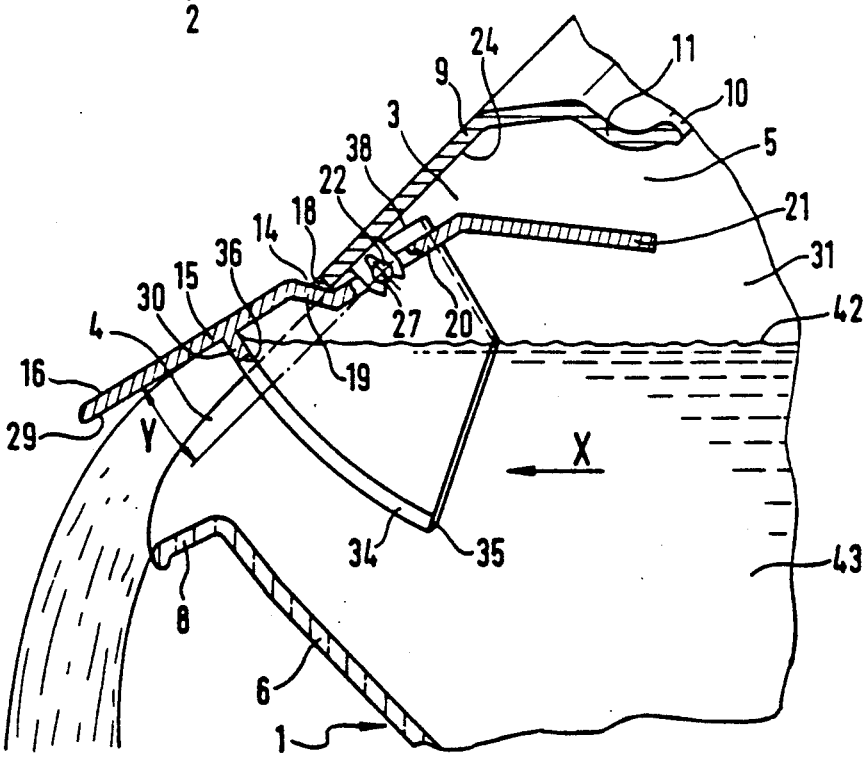
Figure 3:
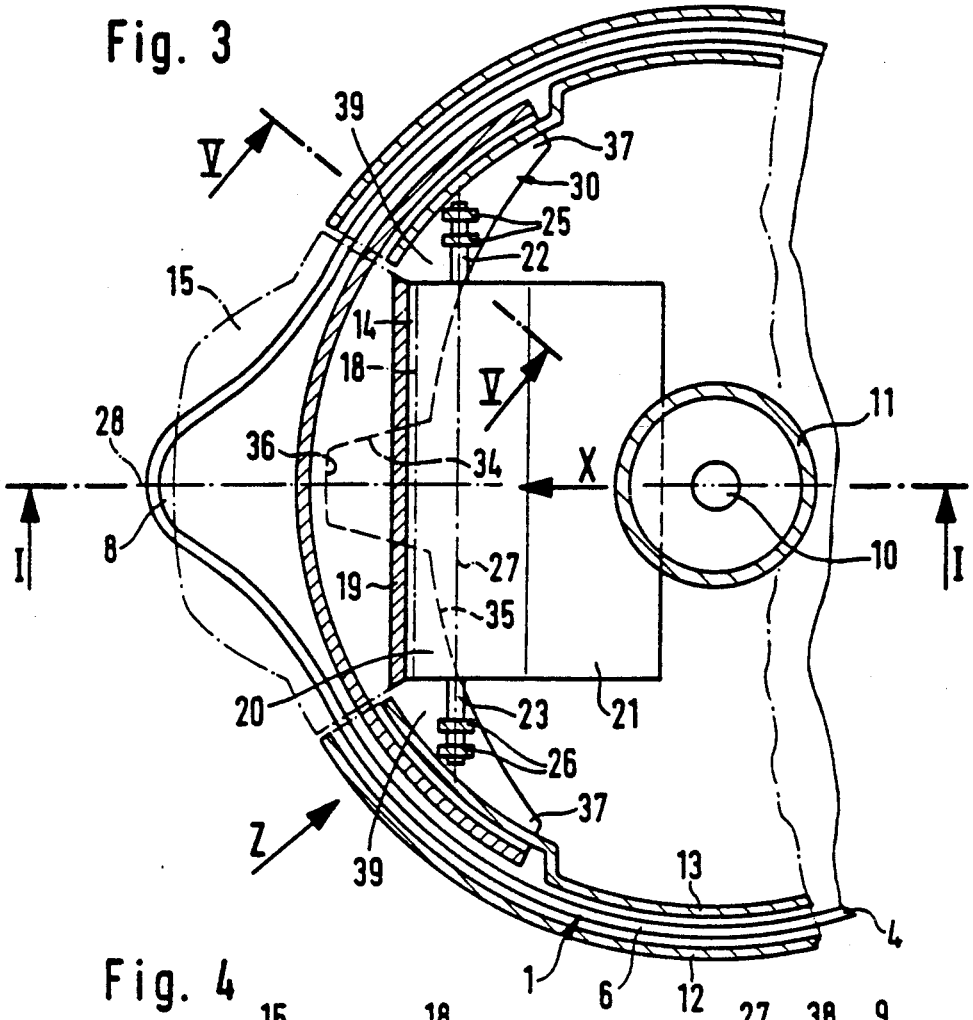
Figure 4:
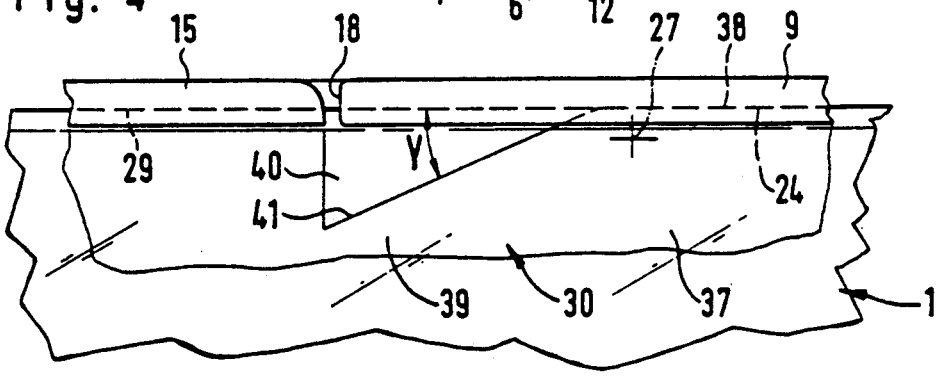
Figure 5:
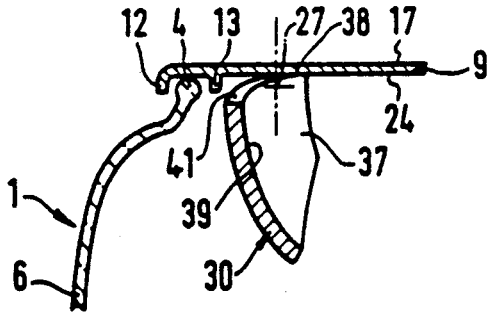

One embodiment of this invention will be described in more detail hereinbelow with reference to the accompanying drawings in which:

FIG. 1 shows a longitudinal cross-section taken through the left-hand half of a glass jug placed on a horizontal rest surface and comprising an inventively designed lid with flap according to the section I—I in FIG. 3, FIG. 2 shows the same illustration of the jug as in FIG. 1, yet with the jug assuming its pouring position, FIG. 3 is a cross-section through the lid taken along the line III—III in FIG. 1, FIG. 4 shows a partial view from without on the glass jug in the direction Z according to FIG. 3, and FIG. 5 shows a partial cross-section through the lid and the jug taken along the line V—V in FIG. 3.

According to FIGS. 1 to 3, the jug is composed of a hollow cylinder 6 with a bottom 2 and a feed opening 5 which is confined on its top side 3 by a brim 4 and has almost the same diameter as the hollow cylinder 6. The jug 1 in FIG. 1 is placed with its bottom 2 on a horizontally extending rest surface 7. Designed on the brim 4 of the jug 1 is a radially outwardly tapering spout 8. The material of the hollow cylinder 6 with bottom 2 is glass, however, any other material apt for containers can be used as well. The jug 1 may be designed also as a heat-retaining jub or a thermos container. As shown in FIGS. 1 through 3, a lid 9 abutting on the brim 4 on the top side 3 of the hollow cylinder 6 includes an opening 10 in the centre of the hollow cylinder 6 which is of a comparatively small diameter. The attched lid 9 extends in parallel to the bottom 2 of the jug 1 and comprises in its mid-portion a funnel-shaped indentation 11 which concentrically encloses the feed opening 10 and which, when the jug 1 is placed underneath a coffee or tea filter not illustrated in the drawing, will lead the brewed beverage exiting from the filter to the feed opening 10.

The radially outer edge of the lid 9 according to FIG. 5 is encompassed by a circumferential rib 12 which is directed towards the jug 1 and radially outwardly confines the brim 4. A second rob 13 directed towares the jug 1 is designed on the lid 9 radially inside the brim 4. These two ribs 12, 13 thus center the lid 9 on the brim 4 of the jug 1. In addition, the inward rib 13 prevents during pouring out that the condensate which possibly gathers on the bottom side 24 of the lid 9 will not flood the brim 4 of the jug 1.

In the area of the spout 8, the lig 9 according to FIGS. 1 through 3 includes a recess 14 which serves to accommodate a flap 15 closing the spout 8 towards the top side. Said flap 15 is disposed with its top side 16 filling the indentation 11 on the same level as the top side 17 of the lid 9 so that the lig 9 forms a unit with the flap 15. Shortly in front of the end surface 18 confining the recess 14, the flap 15 extends transversely downwardly via a connecting portion 19 according to FIGS. 1 and 2 in order that the section 20 adjacent to the connecting portion 19 extends in parallel to the bottom side 24 and below the lig 9. Adjoining the section 20 is an end portion 21 which serves as a counter-weight for the flap 15.

Each one peg 22, 23 projects laterally from the portion 20 of the flap 15 according to FIG. 3, which pegs are buttoned or, respectively, clipped into hanger bearings 25, 26 shaped on the bottom side 21. The connecting line of the two pegs 22, 23 represents the axis of rotation 27 of the flap 15 which extends symmetrically in relation to the axis of symmetry 28 of the spout 8. Said flap 15 is tiltable upwardly by a predetermined andle Y about the axis of rotation 27 according to FIG. 2.

According to FIGS. 1 through 3, a plate 30 is shaped on the bottom side 29 of the flap 15 on the left of the connecting portion 19, the said plate extending in circumferential direction substantially in parallel to the peripheral surface of the container 6 of the jug 1. Said plate 30 further extends into the interior 31 of the jug 1 and is curved such that the wall of the plate 30 is placed on a radium 32 whose centre is disposed roughly on the centre 33 of the lid 9. Extending in parallel and symmetrically in relation to the axis of symmetry 28 on the plate 30 is a passage 34 which begins on the free end 35 of the plate 30 and ends in an edge of turbulence 36 shortly in front of the bottom side 29 of the flap 15. The passage 34 is tapering constantly from the free end 35 towards the edge of turbulence 36.

According to FIGS. 1, 4 abd 5, the second section 37 of the plate 30 extending on the right hand of the axis of rotation 27 abuts on the bottom side 24 of the lid 9 when the lid with the flap 15 assumes the horizontal position illustrated in FIG. 1. On the left of the axis of rotation 27, the plate 30 forms a first section 39 comprising a notch 40 open towards the lid. The upper edge 41 confining the notch 40 extends in FIG. 4 from the upper edge 38 at the level of the axis of rotation 27 in a straight line downwardly in the diorection of the spout 8 and ends outside of the range of effect of the end surface 18, from where it will then extend vertically upwardly again to the bottom side 29 of the plate 15. The angle Y enclosed by the bottom side 24 of the lid 9 and the upper edge 41 corresponds to the tilting angle of the plate 15 (see FIGS. 2 and 4). FIG. 5 depicts once more the course of the upper edge 41 of the notch 40 and of the first and second sections 39, 37 of the plate 30 in a perspective view. As can be clearly seen from FIG. 3, the plate 30 extends symmetrically in relation to the axis of symmetry 28.

To avoid repetitions, like component parts have been assigned like reference numerals in all Figures.

The mode of effect of the flap is as follows:

In the horizontal position of the lid 9 shown in FIG. 1, the flap 15 also assumes a horizontal position since the flap 15 due to its own weight minus the counterweight is twisted counterclockwise by the end portion 21 so far until the upper edge 38 of the second section 37 moves to abut on the bottom side 24 of the lid 9. Depending on whether the end portion 21 is of light weight or heavy, the flap 15 will fall correspondingly lightly or heavily and/or slowly or quickly.

Once the jug 1 is moved into a pouring position, as is shown for instance in FIG. 2, the flap will swivel clockwise around the axis of rotation 27 and moves away from the brim 4 of the container 6 so that the spout 8 is released. Depending on the weight conditions prevailing on the left of the axis of rotation 27 at the flap 15 and on the right of the axis of rotation 27 at the end portion 21, the flap 15 will swing in parallel to the liquid level 42 which always extends horizontally, or it starts to open only beginning from a specific inclined position of the jug 1. In the pouring position, the plate 30 will be immersed almost completely into the liquid 43 so that the passage 34, too, is completely surrounded by liquid (FIG. 2). A slight excess pressure will be caused at the plate 30 due to the liquid flowing in the direction of the arrow X through the passage 34 to the spout 8, the said excess pressure causing the flap 15 to open still further than before, however, only as far as until the upper edge 42 abuts on the bottom side 24. Since the liquid 43 must pass through the waist of the passage 34, the pouring jets concentrated behind the plate 30 will have a higher pouring speed than this is the case with a conventional spout without the inventive flap 15. When the liquid 43 passes through the passage 34, the liquid 43 will be exposed to such turbulences on the edge of turbulence 36 that any drips of condensate which might have collected on the bottom side 29 of the flap 15 will be dragged along by the pouring jet.

Once the pouring operation is completed and the jug 1 is moved to re-adopt its horizontal position, the flap 15 will again close the spout 8 entirely so that the brewed beverage 43 does not suffer from any appreciable loss in aroma and temperature.

We claim:

1. A jug for storing hot beverages, in particular coffee or tea, comprising body structure defining a chamber for storing a hot beverage and having rim structure that defines an upwardly open top portion and spout structure adjacent said rim structure, lid structure for engagement with said rim structure and extending over a major portion of the upwardly open top portion of said body structure and providing an upwardly open region adjacent said spout structure, said lid structure including structure defining a pivot axis that extends substantially transversely to the direction of flow of liquid from said jug via said spout structure, and flap structure including structure in cooperating engagement with said pivot axis defining structure for supporting said flap structure for rotational movement about said pivot axis, said flap structure including a first portion that extends generally forwardly from said pivot axis defining structure and overlies said spout structure in the horizontal position of said jug and a second portion on the side of said pivot axis defining structure opposite said first portion, and an imperforate plate portion extending downwardly from said first portion into said body structure to a point below said spout structure in spaced juxtaposition with said spout structure, and positioned substantially transversely to the direction of flow of liquid from said jug via said spout structure, for submergence into liquid flowing out of said jug through said spout structure when said jug is tilted from a horizontal position into a pouring position to produce a force acting on said flap structure to rotate said flap structure about said pivot axis to move said first portion away from said spout structure, wherein said plate structure includes structure defining a flow passage in juxtaposed alignment with said spout structure for controlling the flow of liquid from said jug through said spout structure.

2. A jug as claimed in claim 1 wherein said passage structure is a symmetrically extending notch in said plate structure whose axis of symmetry extends vertically relative to the horizontal base of said body structure.

3. A jug as claimed in claim 2 wherein said notch structure in said plate structure tapers inwardly in the upward direction towards said first portion of said flap structure.

4. A jug as claimed in claim 1 wherein said plate structure includes a turbulence portion immediately adjacent said first portion and in alignment with said passage structure over which, in said pouring position of said jug, outflowing liquid passes.

5. A jug as claimed in claim 1 wherein said flap structure is of transparent material.

6. A jug as claimed in claim 1 wherein said body structure in the area of said spout structure has a curved peripheral surface, and said plate structure has a curved contour conforming to the curved peripheral surface of said body structure.

7. A jug as claimed in claim 1 and further including stop structure for limiting the rotation of said flap structure about said pivot axis such that said plate structure is not allowed to contact said body structure.

8. A jug as claimed in claim 7 wherein said stop structure comprises a notch portion in said plate structure adjacent said pivot axis and extending below said lid structure, said notch portion having an upper edge portion that begins substantially at the level of said pivot axis and extends at an angle Y.

9. A jug as claimed in claim 1 wherein said second portion functions as a counterweight to said first portion.

10. A jug as claimed in claim 1 wherein said pivot axis extends substantially perpendicularly to the liquid flow direction as defined by said spout structure.

11. A jug as claimed in claim 1 wherein said plate structure is integral with said flap structure and said plate structure extends laterally beyond both sides of said first portion of said flap structure.

12. A jug as claimed in claim 1 wherein said plate structure includes an extension portion that extends beyond said pivot axis of said flap structure, and in said horizontal position of said flap structure, said plate extension portion has an upper surface in engagement with the bottom side of said lid structure.

13. A jug as claimed in claim 12 and further including stop structure for limiting the rotation of said flap structure about said pivot axis such that said plate structure is not allowed to contact said body structure.

14. A jug as claimed in claim 13 wherein said plate structure includes structure defining a flow passage in juxtaposed alignment with said spout structure for controlling the flow of liquid from said jug through said spout structure.

15. A jug as claimed in claim 14 wherein said plate structure includes a turbulence portion immediately adjacent said first portion and in alignment with said passage structure over which, in said pouring position of said jug, outflowing liquid passes.

16. A jug as claimed in claim 15 wherein said body structure in the area of said spout structure has a curved peripheral surface, and said plate structure has a curved contour conforming to the curved peripheral surface of said body structure.

17. A jug as claimed in claim 15 wherein said plate structure is integral with said flap structure and said plate structure extends laterally beyond both sides of said first portion of said flap structure.

18. A jug as claimed in claim 17 wherein said flap structure is of transparent material.

* * * * *